United States Patent [19]

von Lersner

[11] Patent Number: 4,676,279

[45] Date of Patent: Jun. 30, 1987

[54] FILLER FOR ASEPTIC DISPENSING OF PARTICULATE GARNISH

[75] Inventor: Wolf A. von Lersner, Cherry Hill, N.J.

[73] Assignee: Campbell Soup Company, Camden, N.J.

[21] Appl. No.: 739,293

[22] Filed: May 30, 1985

[51] Int. Cl.[4] ..... B65B 3/04

[52] U.S. Cl. ..... 141/1; 141/125; 137/240; 137/243; 222/148

[58] Field of Search ..... 141/89, 90, 91, 92, 141/115-125, 1-12; 137/240, 243; 222/148, 149, 80

[56] References Cited

U.S. PATENT DOCUMENTS

| | | | |
|---|---|---|---|
| 1,097,668 | 5/1914 | Pfouts | 141/392 |
| 2,698,120 | 12/1954 | Fairchild | 137/241 |
| 3,228,412 | 1/1966 | Peterson et al. | 137/240 |
| 3,985,150 | 10/1976 | Kindersley | 137/240 |
| 4,304,252 | 12/1981 | Stanton | 137/240 |
| 4,347,877 | 9/1982 | Hoiss | 141/91 |
| 4,417,610 | 11/1983 | Waldström et al. | 141/91 |

FOREIGN PATENT DOCUMENTS 2308689 9/1974 Fed. Rep. of Germany .

*Primary Examiner*—Houston S. Bell, Jr.

*Attorney, Agent, or Firm*—Banner, Birch, McKie and Beckett

[57] ABSTRACT

An apparatus for aseptically dispensing measured quantities of sterilized particulate garnish, includes identically constructed inlet and outlet valves each having a valve body with a radial port for communication with either a header/reservoir or a product conduit, substantially cylindrical valve members positioned within the valve bodies each with a radial port which when the valve members are rotated communicate with said radial ports in the valve body, enlarged cleaning and sterilizing zones within the cylinder bores of each of the valve bodies for in-line use, and a metering valve. The radial port on the valve member has a cutting edge which is engaged in the normal course of use whenever traversed by fibrous particulate matter such as meats, vegetables, or pulpy fruit. On the suction stroke of the metering valve piston, sterilized particulate garnish is drawn from the supply header/reservoir and is delivered through the outlet valve and nozzle on the dispensing stroke of the piston.

11 Claims, 7 Drawing Figures

FILLER FOR ASEPTIC DISPENSING OF PARTICULATE GARNISH

FIELD OF THE INVENTION

The invention relates generally to a device for aseptically dispensing measured quantities of sterilized particulate garnish.

BACKGROUND OF THE INVENTION

Dispensing devices employed for delivering measured quantities of sterilized liquids have traditionally been designed to minimize contaminate build-up through in-line cleaning or periodic dismantling. Although such designs prove adequate where low viscosity, suspension-free liquids are dispensed, these prior art designs generally are not suitable for handling viscous suspensions, particularly when such suspensions contain particulate solids. Particulates such as meats, fruit, or vegetable fibers tend to block valve ports decreasing throughput and necessitating corrective dismantling.

The general design of prior art liquid dispensing devices is relatively simple. They either depend on an elevated header/reservoir and use a gravity feed-directing valve or use a reciprocating metering piston to draw in a specified quantity of sterilized sample and dispense the same. Low viscosity liquids including milk, oil, or strained fruit juices can be directed to respective collection chambers by the use of conical valves as described in Fairchild, U.S. Pat. Nos. 2,698,120 and Pfouts, 1,097,668. Both valves are seated on the conical walls of a valve housing by means of a resilient spring member compressed by the action of a threading member. In both devices the pressure head created by an elevated reservoir is sufficient to discharge sterilized material as desired. Where a more accurate dispensing device is desired, the prior art teaches the use of a piston head with attached driving means in a sealing relationship with a piston housing, e.g., German Offenlegungschrift 2,308,689.

The use of pistons as valves has traditionally been fraught with contamination problems. As the sample traverses the valve cylinder housing, axial or rotational movement of the piston causes the sample to coat the periphery of the valve, especially where seals have become worn from use. Cleaning procedures have traditionally required the removal of the piston from the valve assembly, increasing the down time of the apparatus.

The use of rotating valves, including ball valves, enhances the overall aseptic integrity of dispensing devices. Like the traditional piston design, however, current ball valve designs are limited to fluids of low viscosity because of their propensity to become blocked. (See Hoiss, U.S. Pat. No. 4,347,877.) Although in-line cleaning is known in the art, blockages are not easily removed with such techniques. The alternative of dismantling the valve, however, requires the expenditure of a great deal of time and effort due to accessibility limitations.

Pistons rotatable about their axes employing recessed grooves to permit selective passage of fluids, suffer the same deficiencies as ball valves when viscous fluids are employed. Although more accessible than ball valves, blocked pistons still must be removed from their cylinder housings to facilitate cleaning.

The prior art dispensing devices are generally undesirable for dispensing particulate garnish because of diminished dispensing efficiency, product loss through contamination, and extended down time for equipment dismantling. Accordingly, apparatus which obviates these problems would be a highly desirable advance in the art of handling foods comprising particulate garnish.

SUMMARY OF THE INVENTION

It is an object of the present invention to provide an assembly for aseptically dispensing measured quantities of sterilized particulate garnish.

More particularly, it is an object of the present invention to provide for the gentle handling of food suspensions.

Another object of the present invention is to provide a rotary valve which remains free from obstructions encountered in the transportation of suspended particulates.

A further object of the present invention is to provide a dispensing assembly which allows for rapid cleaning and sterilization.

Still another object of the present invention is to provide an assembly for metering portions of sterilized particulate garnish, which assembly can be employed in unison with other devices for simultaneous large scale dispensing operations.

In accordance with these and other objectives, the present invention provides, in one aspect, an apparatus for aseptically filling a container with a measured quantity of sterilized particulate garnish comprising in combination; means for supplying particulate garnish suspended in a transport fluid to a cylindrical inlet valve, the cylindrical valve having interconnected radial and axial ports for selectively establishing flow communication between the garnish supply and a product conduit; a metering valve in communication with the product conduit for transporting a measured flow of suspended particulate garnish from the garnish supply into and out of the product conduit; an outlet valve having interconnected radial and axial ports for selectively establishing flow communication between the product conduit and a container to be filled; the radial port of each of the valves having an acute cutting edge for shearing garnish particulates; and means for axially moving the inlet, outlet and metering valves into cleaning and sterilizing chambers.

In a second aspect, the present invention provides a method for aseptically filling a container with a measured amount of sterilized particulate garnish comprising: providing a supply of sterile particulate garnish in a transport fluid, rotating an inlet valve member to an open position and an outlet valve member to a closed position, the valves having interconnecting radial and axial ports with each of the radial ports having an acute cutting edge suitable for shearing garnish particulates trapped in the radial port of the valves; flowing a measured quantity of the suspended particulate garnish through the inlet valve member and into a product conduit on the suction stroke of the metering valve piston; rotating the inlet valve member to a closed position; rotating the outlet valve member to an open position; and displacing the measured quantity of suspended particulate garnish on the discharge stroke of the metering valve piston through the outlet valve member and into a container to be filled.

BRIEF DESCRIPTION OF THE DRAWINGS

The present invention will be more readily understood by reference to the accompanying drawings in which.

DETAILED DESCRIPTION OF THE INVENTION

The dispensing apparatus and method of the present invention results in consistent delivery of a measured quantity of particulate garnish with a clean cutoff at the nozzle, and without product damage attributable to excessive pressures or shearing forces. The use of a valve assembly with the capacity to be rotated around its axis and displaced axially for cleaning and sterilizing within the valve bore is important to maintain the aseptic character of the apparatus. When dispensing quantities of garnish particulates, the cutting edge of each valve's radial port prevents clogging and particulate damage during the normal rotational movement employed when opening and closing the valve. The present invention overcomes losses in operation time and expense required by blockage removal procedures used in the prior art. The ability to both clean and sterilize the interior and exterior surfaces of the valve member by axial displacement within the cylinder bore, permits the apparatus to perform under automated circumstances such as in large scale dispensing operations.

The dispensing and packaging of measured quantities of perishable substances becomes more difficult when viscous or fibrous materials are selected. Due to poor flow characteristics, methods utilizing gravity feed as the main force in moving viscous fluids are often supplemented by piston-like means. The particulate or fibrous food materials in fluids often become lodged in valve openings and recesses, thereby damaging the food materials, disrupting the operating sequence and necessitating costly cleaning services. In the design of the present invention, these problems are overcome.

Figures 1, 6:
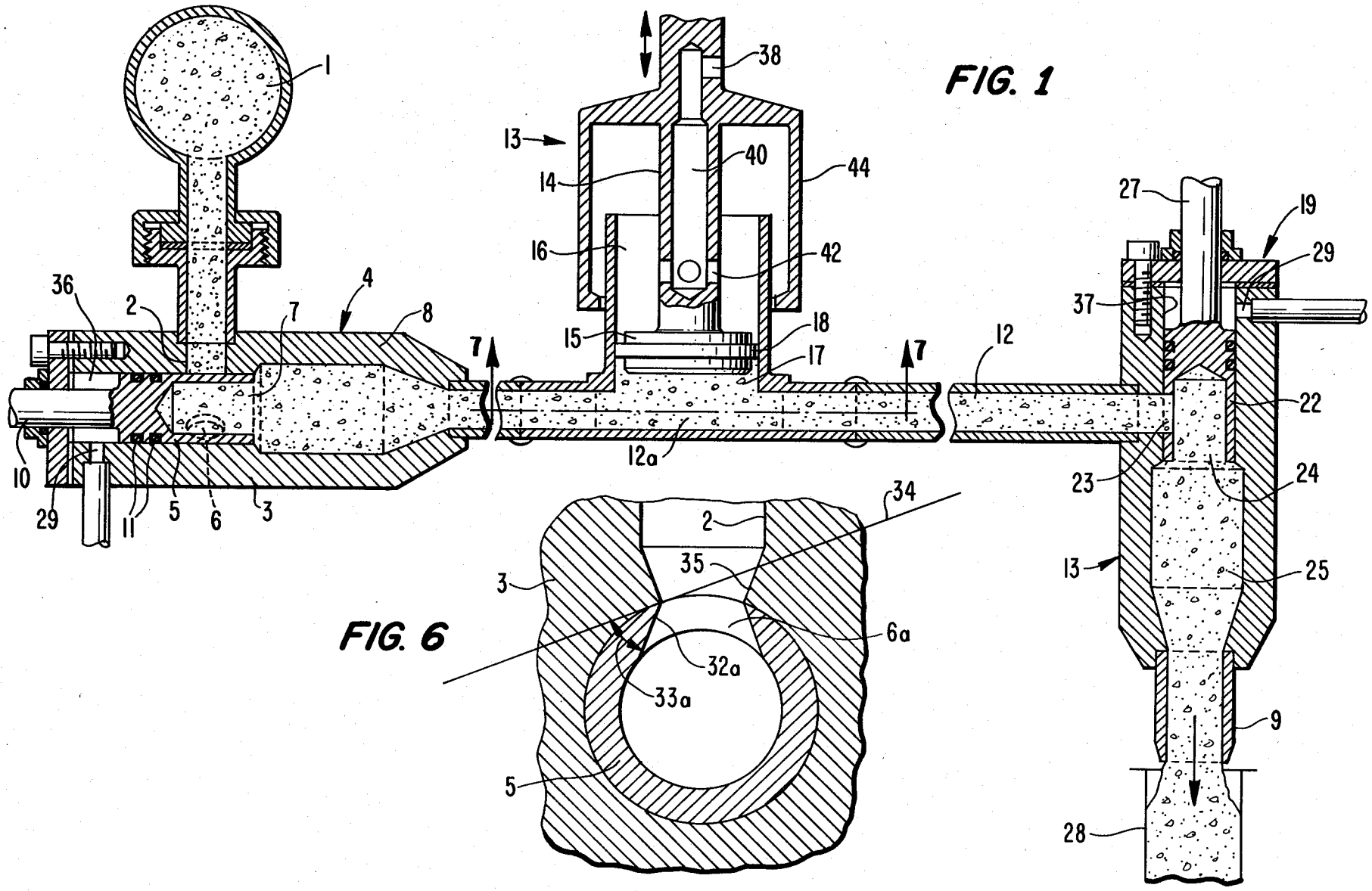
FIG. 1 is a cross-sectional view of apparatus for dispensing measured quantities of sterilized particulate garnish suspensions.
FIG. 6 is a cross-sectional view as shown in FIG. 3, illustrating an open valve with oppositely oriented cutting edges on both the radial opening of the valve member and the valve body.

In dispensing a suspension of particulate garnish, it is desirable to employ a detachable vertically oriented header/reservoir 1 to provide a pressure head for assisting movement of the food material. It is recognized that the reservoir may be of any geometric shape so long as communication is assured with an inlet valve 4, product conduit 12 and a metering valve 13. The reservoir may be constructed of any material commonly known in the food dispensing art such as stainless steel. As illustrated in FIG. 1, header/reservoir 1 is attached to the cylindrical valve body 3 of inlet valve 4.

Figure 2:
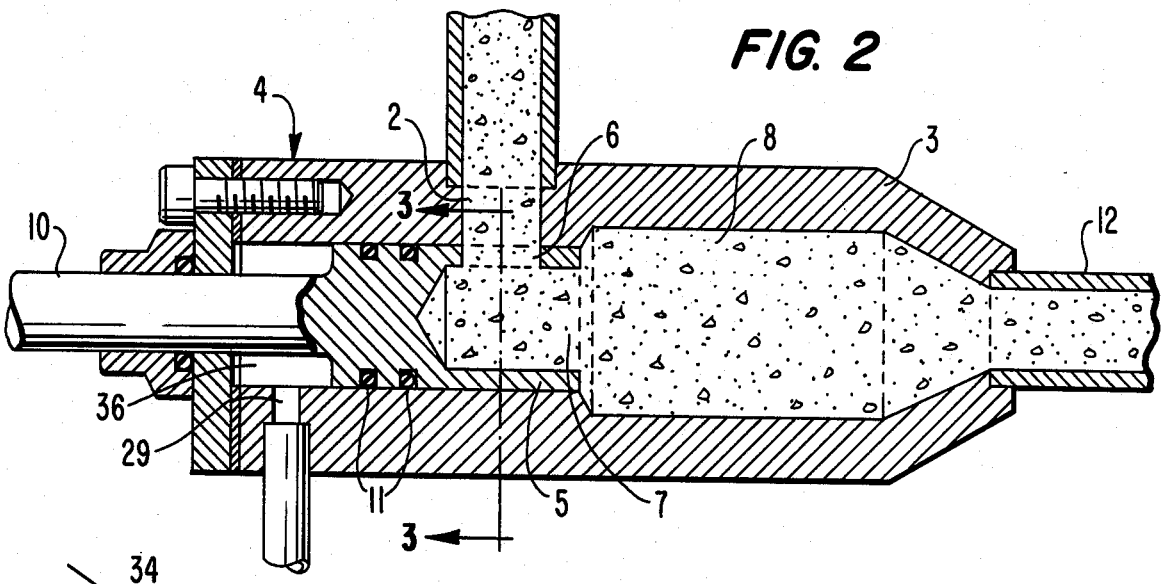
FIG. 2 is an enlarged cross-sectional view of the inlet valve shown in the open position.

Inlet valve 4 (shown more clearly in FIG. 2) is employed for controlling the flow of sterilized particulate garnish suspended in a transport fluid. The valve body 3 has a substantially cylindrical bore with a radial port 2 which communicates with header/reservoir 1. A substantially cylindrical valve member 5 fits in a sealing relationship with the bore 36 of the valve body 3 so as to maintain the sterile characteristics of the product conduit 12 and the food suspension. The valve may be composed of any material resistant to corrosion commonly employed in the art and preferably of waukesha metal or stainless steel. Sealing means 11 known to the art, include the use of silastic or Teflon o-rings, Viton or other resilient materials.

Inlet valve member 5 has interconnecting radial port 6 and axial port 7 for establishing communication between header/reservoir 1 containing the particulate garnish supply and the product conduit 12. The inlet valve may be selectively opened and closed by rotating the attached control rod 10. A preferred embodiment provides for the use of a stainless steel rod. The means for displacing the rods may be by any method known in the art including air pistons. The control rod 10 also permits the valve member 5 to be moved axially, into an enlarged cleaning and sterilizing chamber 8 axially aligned with the cylinder bore 36 (shown more clearly in FIG. 5). In the illustrated embodiment, the cleaning and sterilizing chamber 8 is defined by an extension of the valve body 3.

Figure 3:
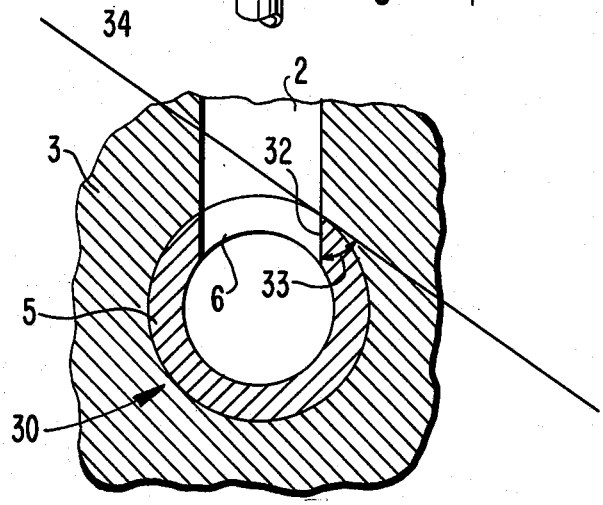
FIG. 3 is a cross-sectional view taken along lines 3—3 of FIG. 2 illustrating the cylindrical bore of the valve member in registry with a radial port in the valve body.
Figure 4:
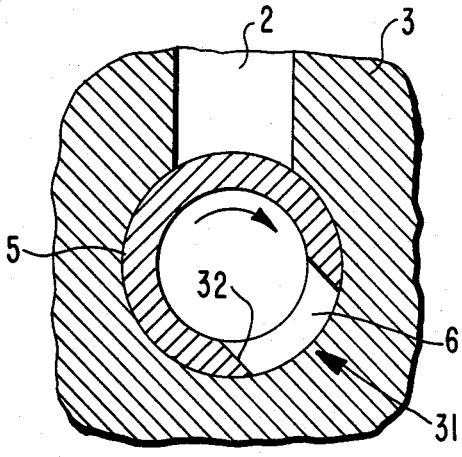
FIG. 4 is a similar cross-sectional view as shown in FIG. 3, illustrating the valve in the closed position.

The radial port 6 in the inlet valve member 5 is equipped with an acute cutting edge 32 for shearing garnish particulaes such as meat or fibrous vegetables trapped between the radial port 2 of the valve body 3 and the radial port 6 of inlet valve member 5. The acute cutting edge 32, shown clearly in FIG. 3, forms an angle 33 with a tangent 34 to the outer diameter of the valve member 5 at the edge of the radial port 6 of less than 90°, and preferably between about 20° and about 70°. The cutting edge is designed to sever trapped garnish particulates during the normal course of operation without destroying the physical characteristics of the garnish. Rotation of the inlet valve member 5 about its axis (see FIGS. 3 and 4) or any axial displacement along the cylinder bore (see FIG. 5) is sufficient to engage the edge 32 of the radial port 6 (FIG. 2) with the valve body 3.

Selection of the optimum cutting angle between the radial port 6 of the inlet valve member 5 and the communicating surface of the valve body 3 will depend primarily on the materials and manufacturing methods used in valve construction. Most preferably, the cutting edge has an angle between about 30° and about 50°. At angles above 60° particulates trapped during movement of the valve member tend to be damaged while angles lower than about 30° become progressively more expensive to machine. It is also contemplated that the edge be composed of hardened or treated materials to reduce dulling with use.

Another embodiment of the present invention, illustrated in FIG. 6, includes the use of an oppositely oriented cutting edge 35 on the inner surface of the valve body 3 positioned to engage particulate matter in a scissoring manner with cutting edge **32*a* of radial port 6*a*. Edge 32*a* forms an angle 33*a* with a tangent 34 to the outer diameter of valve member 5** at the edge of the radial port 6*a* of less than 90°, and preferably between about 20° and about 70°.

Figure 7:
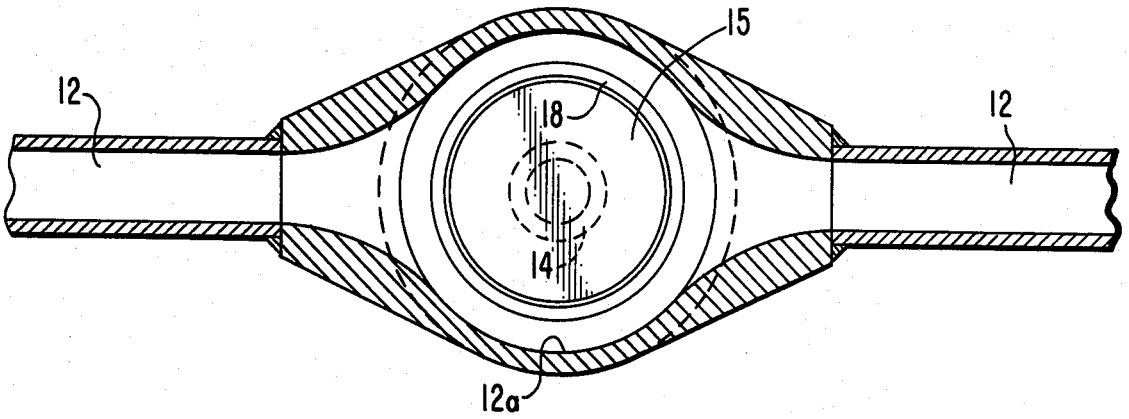
FIG. 7 is a sectional view taken along line 7—7 of FIG. 1, illustrating the metering valve cleaning chamber.

A metering valve 13, as illustrated in FIGS. 1 and 7, is attached to the product conduit 12 to assist in the withdrawal of metered portions of particulate garnish from the header reservoir 1. The metering valve 13 typically consists of a substantially cylindrical housing 16 through which a piston head 15 moves in a sealing relationship. A piston rod 14 has a central cleaning conduit 40 with inlet 38 and outlet ports 42. Connected to the piston rod is an outer valve jacket 44 which moves in relationship with the outer wall of housing 16 when the piston 15 is moved. The present invention utilizes the withdrawing stroke of the piston rod 14 to assist the removal of the particulate garnish from header/reservoir 1 by suction. The design of the piston head 15 and housing 16 are well known in the art and should be of sufficient dimension to meter the desired quantity of sterilized food substance to be packaged. The piston head 15 sealingly communicates with the inner wall of housing 16 by means of a piston ring 18, formed of silastic, Teflon, Viton or other resilient material well known to the art. A preferred sealing material is Viton. As seen in FIG. 7, product conduit 12 contains an enlarged zone 12*a*, directly below the metering valve 13. Piston head 15 can be axially displaced downwardly into enlarged zone 12*a* to permit cleaning and sterilization. The normal metering stroke of piston 15, however, is controlled to maintain the piston ring 18 in sealing relationship with the inner wall of housing 16.

As illustrated in FIG. 1, an outlet valve 19 of the same design as the inlet valve 4 is positioned between a dispensing nozzle 9 and the product conduit 12. The radial port 23 of the outlet valve member 22 communicates with the discharge end of the product conduit 12 rather than with header/reservoir 1 and the axial port 24 communicates with discharge nozzle 9 rather than product conduit 12. A preferred orientation of the outlet valve is generally perpendicular to the product conduit and axial to the dispensing nozzle 9.

The present invention provides a method for aseptically filling a container with a measured amount of sterilized particulate garnish suspended in a transport fluid. The present invention may also be employed for dispensing sterilized paste or paste equivalents throughout a wide range of temperatures. Dispensing various fruit supplemented ice creams also is contemplated by the invention.

In operation, a measured quantity of sterilized particulate garnish suspended in a transport fluid is removed from header/reservoir 1 by first rotating inlet valve member 5 about its axis to an open position 30 (see FIG. 3) by turning the control rod 10 connected to the valve member 5, thereby establishing communication between header/reservoir 1 and the radial port 6 of the valve member. Valve member 22 of outlet valve 19 is rotated to a closed position 31 (see FIG. 4). Piston head 15 of metering valve 13, illustrated in FIG. 1, is drawn away from product conduit 12, thereby drawing particulate garnish suspension from header/reservoir 1, through the opened inlet valve 4, through product conduit 12 and into the working chamber 17 of the metering valve 13 by the suction created. To discharge this material, the inlet valve member 5 is rotated to a closed position 31 (see FIG. 4) and outlet valve member 22 is rotated to an open position 30 (see FIG. 3) by turning control rods 10 and 27. The reciprocating piston 15 of metering valve 13 is pushed toward product conduit 12 forcing particulate garnish suspension through the product conduit 12, open outlet valve 19 and dispensing nozzle 9.

The product conduit 12 should be filled before a metered portion of the sterilized suspension may be correctly apportioned. This may be accomplished by an initial priming sequence mimicking the filling and dispensing cycle discussed above.

Using the described arrangement, a quantity of aseptic particulate garnish is delivered through the dispensing nozzle 9 with a clean cutoff. Material suitable for the nozzle is well known in the art. Its characteristics are determined primarily by the size of the container to be employed and the corrosiveness of the sterilized suspension to be packaged. The nozzle also allows facile connection of a spring loaded end plug prior to a cleaning and sterilization cycle (described hereafter) and for condensate drainage. The plug can be of any resilient low wear material including neoprene or Viton.

Periodic cleaning and sterilizing of the apparatus of the present invention is initiated by axially displacing inlet valve member 5 and outlet valve member 22 through their respective cylindrical bores 36 and 37 into their enlarged cleaning and sterilizing chambers or zones 8 and 25 of the valve bodies 3 and 20 (FIG. 1) by applying axial pressure to control rods 10 and 27 attached to the valves. Cleaning and sterilization of the apparatus is further facilitated by axially displacing piston head 15 into enlarged zone 12*a*.

Figure 5:
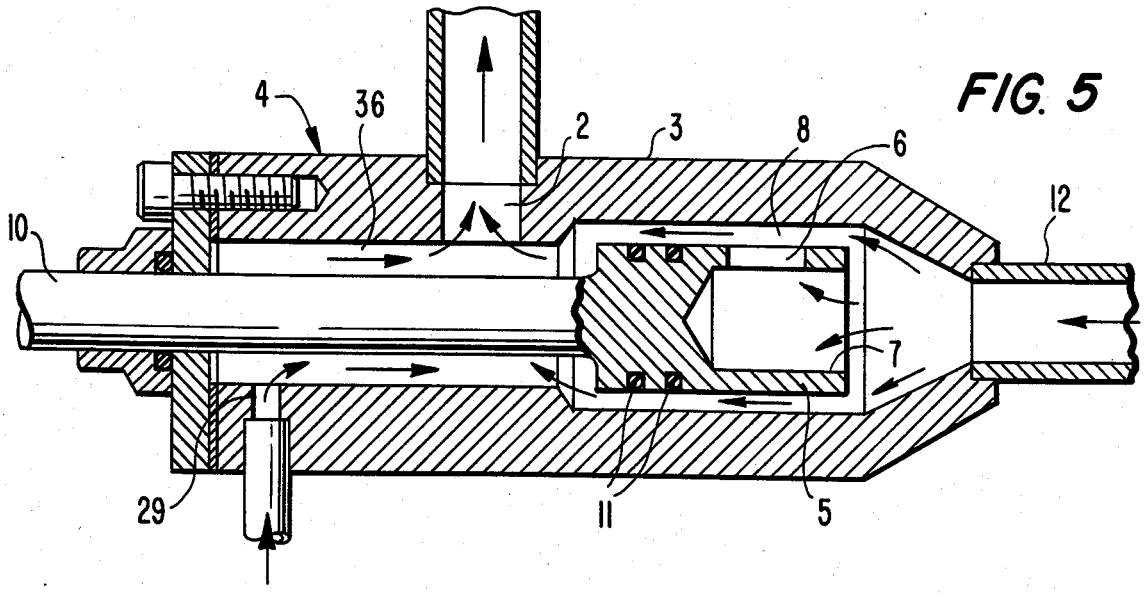
FIG. 5 is a cross-sectional view as shown in FIG. 2, illustrating the valve assembly in the cleaning or sterilizing position.

Cleaning materials such as caustic solutions, rinsing materials such as hot water and sterilizing materials such as steam are introduced through access ports 29 and 38 as indicated in FIGS. 1 and 5. Caustic solutions known in the art include solutions of alkali metal hydroxides such as sodium or potassium hydroxide. Chemical sterilization with peroxide compounds such as hydrogen peroxide is also contemplated by the invention. After cycling cleaning materials through the system, hot water is used to flush out any residue followed by flushing with steam.

This method exposes all surfaces of the valves including the central bore, the radial port, and the exterior surface of the valve member, to cleaning, rinsing and sterilizing. With all three valves positioned in their respective enlarged zones 8, 12*a* and 25 the cleaning and sterilizing materials communicate throughout the apparatus including nozzle 9, metering valve 13, housing 16, and header/reservoir 1.

While preferred embodiments of the present invention have been shown and described herein, it is intended that many structural details may be changed without departing from the spirit and scope of the invention as defined by the appended claims.

The invention is claimed as follows:

1. Apparatus for aseptically filling a container with a measured quantity of sterilized particulate garnish comprising in combination:

(a) means for supplying particulate garnish suspended in a transport fluid from a header/reservoir to an inlet valve having a substantially cylindrical valve member within a valve body;

(b) said cylindrical valve member having interconnecting radial and axial ports for selectively establishing flow communication between said garnish supply and a product conduit;

(c) a metering valve in communication with said product conduit for transporting a measured flow of suspended particulate garnish from said garnish supply into and out of said product conduit;

(d) said metering valve having a piston head slidably disposed within a valve body;

(e) an outlet valve having a substantially cylindrical valve member within a valve body, said substantially cylindrical valve member having interconnecting radial and axial ports for selectively establishing flow communication through said product conduit, a connecting nozzle, and a container to be filled;

(f) said radial port of each of said valves having an acute cutting edge for shearing garnish particulates trapped between said valve member and said valve body;

(g) said inlet, outlet, and metering valves each having a cleaning and sterilizing zone into which said substantially cylindrical valve members or said piston head can be moved;

(h) said cleaning and sterilizing zones being larger than said valve members or said piston head so that cleaning and sterilizing fluids can flow around and through said valve members and around said piston head when said valve members and said piston head are moved into said cleaning and sterilizing zones;

(i) means for moving said piston head into said metering valve cleaning and sterilizing zone; and (j) means for axially moving the substantially cylindrical valve members of said inlet and outlet valves into said inlet and outlet valve cleaning and sterilizing zones.

2. A method for aseptically filling a container with a measured amount of sterilized particulate garnish from a dispensing apparatus comprising inlet and outlet valves, each with interconnected radial and axial ports, connected by a product conduit which includes a piston-type metering valve, wherein the inlet and outlet valves are provided with means on the radial ports to shear garnish particulates that tend to prevent complete closure of the valve, said method comprising the steps of:

(a) providing a supply of sterile particulate garnish suspended in a transport fluid;

(b) rotating said inlet valve to an open position and said outlet valve to a closed position, said outlet valve shearing any garnish particulates that are in the path of closure of said outlet valve to prevent incomplete closure of said outlet valve;

(c) flowing a measured quantity of said suspended particulate garnish through said inlet valve, and into said product conduit on the suction stroke of said piston-type metering valve;

(d) rotating said inlet valve to a closed position and said outlet valve to an open position, said inlet valve shearing garnish particulates that are in the path of closure of said inlet valve to prevent incomplete closure of said inlet valve; and (e) displacing said measured quantity of suspended particulate garnish on the discharge stroke of said metering valve through said outlet valve and into a container to be filled.

3. A valve for controlling the flow of sterilized particulate garnish in a transport fluid comprising:

(a) a valve body having a cleaning and sterilizing zone and a substantially cylindrical bore with a radial port through said body;

(b) a substantially cylindrical valve member sealingly positioned in the cylindrical bore of said body, said valve member having a radial port with an acute cutting edge suitable for shearing particulates trapped between said valve body and said valve member;

(c) means operatively connected to the valve member for rotating the valve member about its cylindrical axis and registering the radial port of the valve member with the radial port of the valve body; and (d) means for axially displacing the valve member through the cylindrical bore into the cleaning and sterilizing zone, said cleaning and sterilizing zone being larger than said valve member so that cleaning and sterilizing fluids can flow around and through said valve member when said valve member is displaced into said cleaning and sterilizing zone.

4. A method for cleaning and sterilizing apparatus for aseptically filling a container with a measured quantity of sterilized particulate garnish comprising in combination a product conduit communicating between inlet and outlet valves, each valve having a substantially cylindrical valve member and a cleaning and sterilizing zone into which said valve member can be displaced, and a metering valve disposed between said inlet and outlet valves in communication with said product conduit and having a piston head which can be displaced into a cleaning and sterilizing zone larger than said piston head; said method comprising:

(a) axially displacing the substantially cylindrical inlet and outlet valve members and the metering valve piston head into their respective cleaning and sterilizing zones;

(b) transporting cleaning, rinsing, or sterilizing material into the zones;

(c) passing the cleaning, rinsing, or sterilizing material through the valves, thereby surrounding, cleaning, rinsing, or sterilizing the valves, the valve members, and the piston head; and (d) flowing the cleaning, rinsing or sterilizing materials through the valves and the product conduit.

5. The method of claim 4 wherein said cleaning material is a caustic solution and said rinsing material is hot water.

6. The method of claim 5 wherein said sterilizing material is a peroxide compound.

7. The method of claim 5 wherein said sterilizing material is steam.

8. The apparatus of claim 1 wherein said acute cutting edge has an angle between about 20° and about 70°.

9. The method of claim 2 wherein said means on the radial ports to shear garnish particulates comprises an acute cutting edge that has an angle between about 20° and about 70°.

10. The valve of claim 3 wherein said acute cutting edge has an angle between about 20° and about 70°.

11. The valve of claim 3 wherein said cleaning and sterilizing zone comprises an enlarged chamber axially aligned with said substantially cylindrical bore.

* * * * *